US006219996B1

(12) United States Patent
Searle

(10) Patent No.: US 6,219,996 B1
(45) Date of Patent: Apr. 24, 2001

(54) SYSTEMS FOR FILLING NON-ROUND CONTAINERS, ESPECIALLY FROZEN DESSERT CONTAINERS

(75) Inventor: William J. Searle, Glen Burnie, MD (US)

(73) Assignee: Sweetheart Cup Company, Inc., Owings Mills, MD (US)

( * ) Notice: Subject to any disclaimer, the term of this patent is extended or adjusted under 35 U.S.C. 154(b) by 0 days.

(21) Appl. No.: 09/312,057

(22) Filed: May 17, 1999

(51) Int. Cl.[7] ..... B65B 3/06; B65B 3/26; B65B 7/28

(52) U.S. Cl. ..... 53/282; 53/284.5; 53/314; 53/389.1; 141/125; 141/311 A

(58) Field of Search ..... 414/795.8; 222/553, 222/554, 555; 141/311 A, 125, 163, 172, 174; 53/281, 282, 283, 284.5, 329.5, 235, 313, 314, 316, 389.1

(56) References Cited

U.S. PATENT DOCUMENTS 732,123 * 6/1903 Schneider .
766,433 * 8/1904 Von Echt .
1,039,770 * 10/1912 Malmquist .
1,070,222 * 8/1913 Zeiler .
1,401,150 * 12/1921 Geyer .
1,659,802 * 2/1928 Bergmann .
2,310,413 * 2/1943 Friden .
2,605,948 * 8/1952 Bridge .
2,734,673 * 2/1956 Hazel ..... 53/314
2,817,935 * 12/1957 Fischer et al. .
3,228,412 * 1/1966 Peterson et al. .
3,491,510 * 1/1970 Sternau .
3,574,270 * 4/1971 Rosendahl .
3,938,697 * 2/1976 Kinney .
4,077,180 * 3/1978 Agent et al. .
4,375,826 * 3/1983 Stohlquist .
4,401,238 * 8/1983 Marchadour .
4,558,802 * 12/1985 Molison .
4,618,054 * 10/1986 Muller .
4,683,016 * 7/1987 Dutt et al. .
4,796,406 * 1/1989 Giles et al. .
4,835,943 * 6/1989 Mueller ..... 53/202
4,907,941 * 3/1990 Focke et al. .
4,999,978 * 3/1991 Kohlbach et al. .
5,050,367 * 9/1991 Heisler ..... 53/313
5,154,315 * 10/1992 Dominico et al. .
5,304,030 * 4/1994 Neri .
5,435,432 * 7/1995 Tacchi et al. .
5,784,863 * 7/1998 Davis .

* cited by examiner

*Primary Examiner*—John Sipos
(74) *Attorney, Agent, or Firm*—Nixon & Vanderhye P.C.

(57) ABSTRACT

Container filling systems include a container filling station which fills empty containers with a product, most preferably a frozen dessert. The container filling station will necessarily include a fill valve assembly which has a housing defining a inlet and discharge openings, and a cylindrical spool having a spool port defined therethrough. Preferably, the spool is mounted asymmetrically within said housing for rotation between an open and closed conditions. A container lid supply and transfer system is most preferably employed in the system of this invention and includes a lid supply assembly to provide an available stand-by supply of container lid stacks, a lid feeding assembly for sequentially feeding individual container lids onto an awaiting product-filled container, and a lid transfer assembly for transferring a lid stack from the lid supply assembly to the lid feeding assembly. Most preferably, the lid transfer assembly pivotally moves between a loading position (wherein a lid stack from the lid supply assembly may be loaded thereon), and an unloading position (wherein the lid stack supported by the lid transfer assembly is aligned with the lid stack supported by the lid feeding assembly).

17 Claims, 11 Drawing Sheets

39-1a
39-1
39-2
SC
39-3
38-2
34-8
5A,B
B
CF
34-9
34-2
34-5
38-3
38-5
38-6
34-1
34
36
38-1
36-4
36-5
36-1
38-7
32
34-6
C
26
31

SYSTEMS FOR FILLING NON-ROUND CONTAINERS, ESPECIALLY FROZEN DESSERT CONTAINERS

FIELD OF THE INVENTION

The present invention relates generally to the field of container filling systems. In preferred forms, the present invention is embodied in systems which serve to fill non-round containers with a flowable semi-solid dessert (e.g., ice cream, ice milk, yogurt or the like).

BACKGROUND AND SUMMARY OF THE INVENTION

Frozen desserts are preferred to be transported and introduced into product containers in a flowable, but relatively "stiff" (highly viscous), condition so that the product within the containers can withstand the centrifugal forces associated with the filling machine indexing system. Thus, if the frozen dessert is introduced into the container in a less viscous condition than is ideal (i.e., less "stiff" in art parlance), then the continual starting/stopping of the container filling machine may cause the relatively "loose" product in the container to spill over the container sides.

The stiffer the frozen dessert, however, the greater the tendency for it to form "tails" at the container filling valve. That is, the frozen dessert may form a bridge (called a "tail" in art parlance) between the filled container and the fill valve which sometimes will drape over the sides of the container as the filled container is indexed to the next station of the filling machine. In order to alleviate this tailing problem, fill valves have been provided with a scissors-type mechanism which cuts the tail physically and thereby prevents it from draping over the container side. However, in order to prevent a build-up of frozen-dessert residue (which would be unsanitary over time), it is typically necessary to heat the scissors-type mechanism and/or clean it at regular intervals.

Relatively stiff frozen desserts also pose the problem of incomplete container filling. That is, because the flowability of the frozen dessert decreases with an increase in viscosity (decrease in temperature), it may not flow into, and conform with, the corner of the container—e.g., the region where the container side wall merges with the container bottom wall. This incomplete filling problem has been solved in the past by physically spinning round containers during the filling process so that the centrifugal force created by the spinning container will ensure that its interior volume is completely occupied by the frozen dessert. However, spinning of non-round containers is not a practical solution to that problem. Thus, when using conventional fill valves to fill non-round containers, the frozen dessert must be less stiff (i.e., less viscous) which leads to the potential spillage problem noted above during container indexing.

What has been needed in this art, therefore, are improved systems and methods for filling non-round containers with frozen desserts in a flowable, but semi-solid state. It is towards fulfilling such a need that the present invention is directed.

Broadly, the present invention is embodied in container filling system comprising a container filling station which fills empty containers with a product, most preferably a frozen dessert. The container filling station will necessarily include a fill valve assembly in accordance with the present invention. More specifically, the fill valve assembly includes a housing defining a inlet and discharge openings, and a cylindrical spool having a spool port defined therethrough. Preferably, the spool is mounted asymmetrically within said housing for rotation between an open condition (wherein the spool port is aligned with the inlet and discharge openings of the housing to allow product to be pass therethrough and discharged into an awaiting container), and a closed condition (wherein the spool blocks said inlet and discharge openings to prevent product from being discharged into a container). In such a manner, product "tailing" is minimized (if not prevented entirely).

The container fill valve is most preferably employed in the system of this invention with a container lid supply and transfer system. The container lid supply and transfer system of this invention includes a lid supply assembly to provide an available stand-by supply of container lid stacks, a lid feeding assembly for sequentially feeding individual container lids onto an awaiting product-filled container, and a lid transfer assembly for transferring a lid stack from the lid supply assembly to the lid feeding assembly. Most preferably, the lid transfer assembly pivotally moves between a loading position (wherein a lid stack from the lid supply assembly may be loaded thereon), and an unloading position (wherein the lid stack supported by the lid transfer assembly is aligned with the lid stack supported by the lid feeding assembly).

Further aspects and advantages of the present invention will become more clear after careful consideration is given to the detailed description of the preferred exemplary embodiments thereof.

BRIEF DESCRIPTION OF THE ACCOMPANYING DRAWINGS

Reference will hereinafter be made to the accompanying drawings wherein like reference numerals throughout the various FIGURES, and wherein.

DETAILED DESCRIPTION OF THE INVENTION

Figure 1:
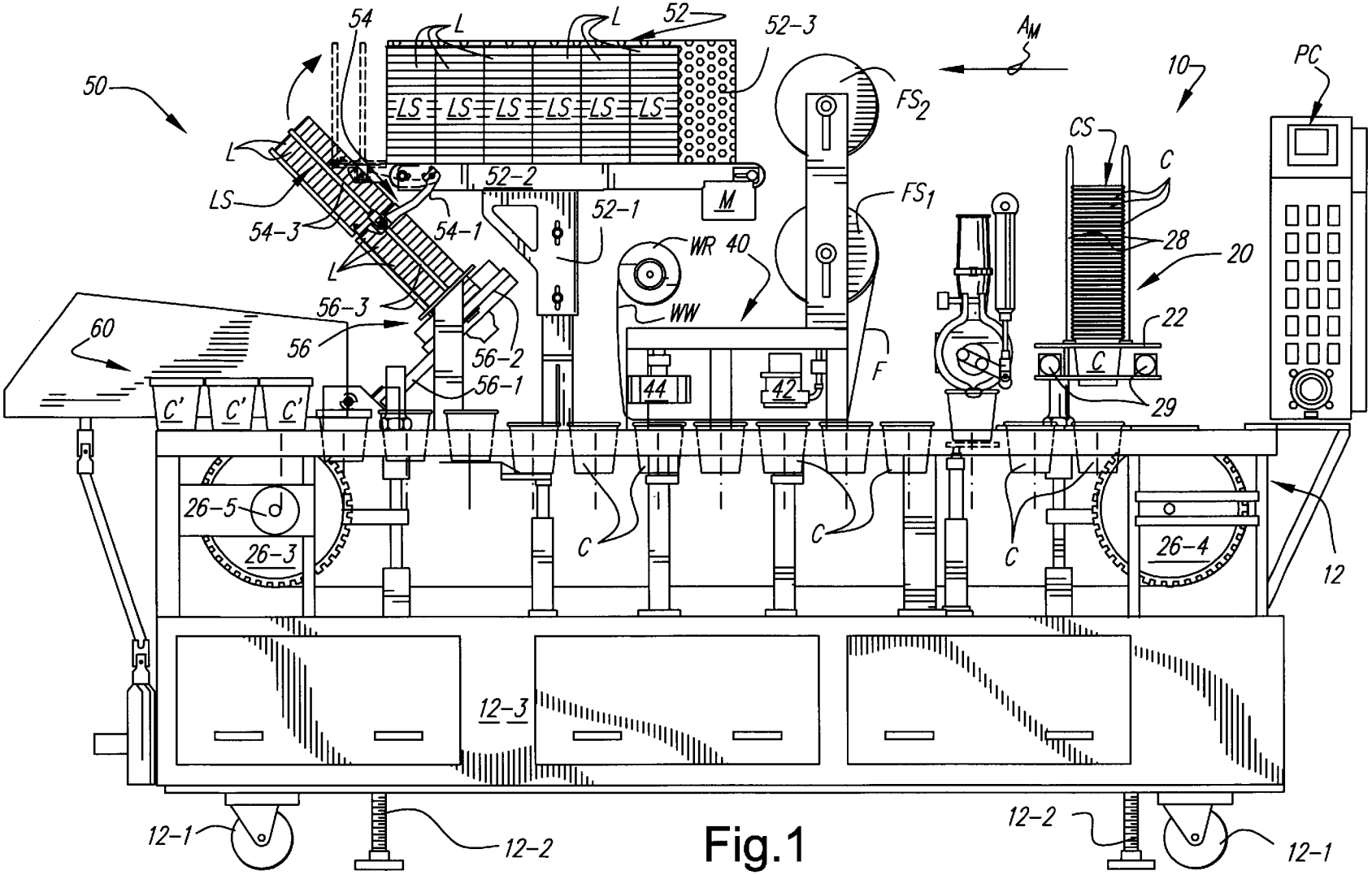
FIG. 1 is a side elevational view of a non-round container-filling system in accordance with the present invention.

Accompanying FIG. 1 depicts a preferred container-filling system 10 in accordance with the present invention. As shown, system 10 includes a frame assembly 12 which supports the various structural components and stations to be described in greater detail below. Most preferably, the frame 12 is provided with castor wheels 12-1 which allow the frame 12, and hence the entire system 10, to be maneuvered along a production room floor. Stabilizer feet 12-2, however, may be extended to ensure that the system 10 remains stationary once its location has been determined. The frame 12 also supports a cabinet 12-3 which houses the various motors, hydraulic lines and the like (not shown), the operation and timing of which are controlled by the programmable controller PC.

The frame support a number of production stations which serve to fill empty containers (a few of which are noted by the reference identifier C). Specifically, the frame supports a container dispensing station 20, a container filling station 30, a sanitary covering station 40, a lidding station 50 and a product container discharge station 60.

Figure 2:
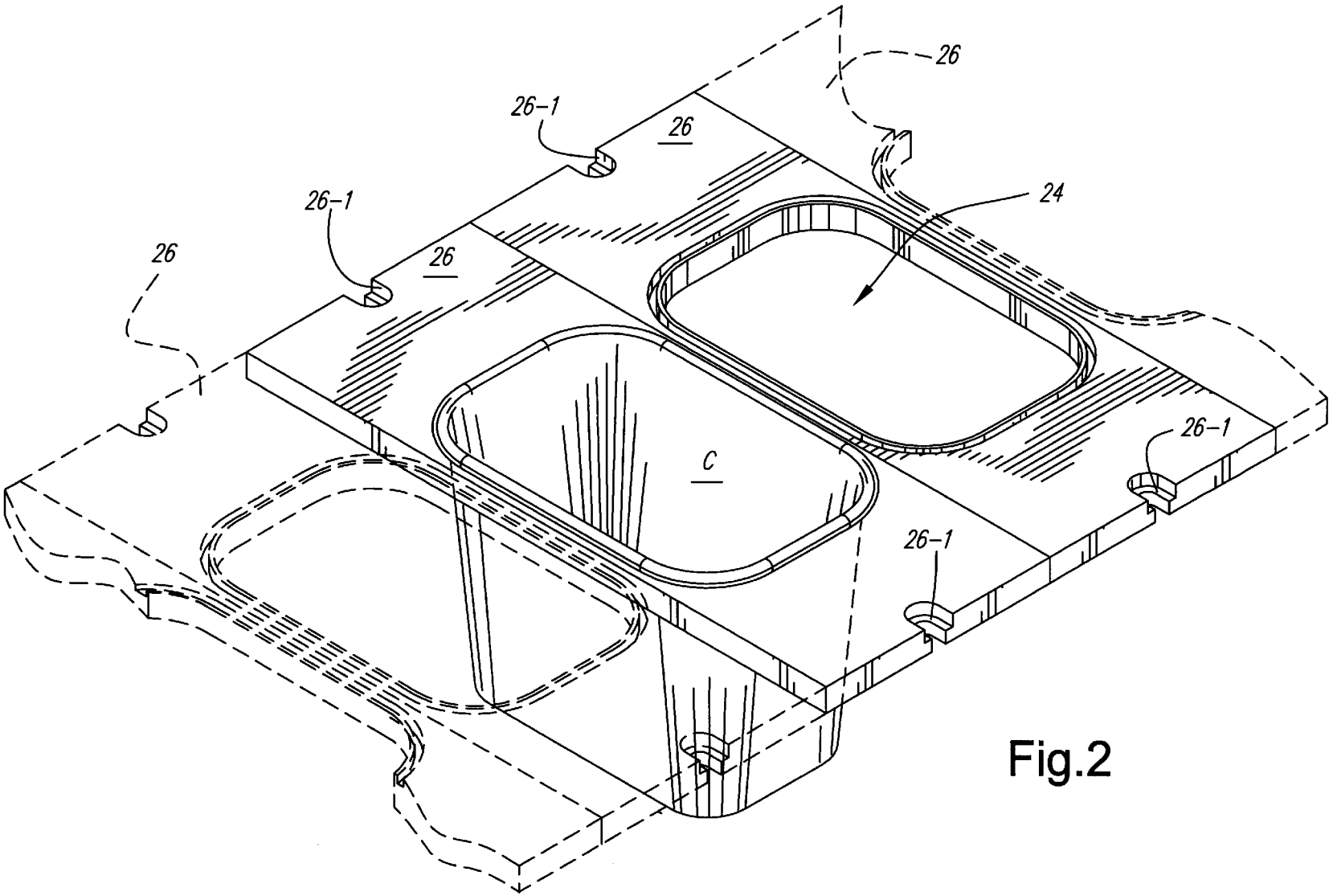
FIG. 2 is a detailed perspective view of a section of conveyor plates which support the containers as they travel along the production path in the machine direction.

The container dispensing station 20 includes a support plate 22 through which individual ones of the empty containers C in the container stack CS pass in registry with a correspondingly configured receptacle aperture 24 in a conveyor plate 26 (see FIG. 2). The support plate 22 supports a number of upright posts 28 which stabilize the container stack CS. As is conventional, the support plate 22 includes finger members (not shown) which may be moved into and out of engagement with the rim of the container C by means of suitable pneumatic actuators 29. Thus, by controllably actuating the actuators 29 (which control is exercised by the programmable controller and suitable solenoid valves in the frame 12-3), the last container C in the stack CS may be allowed to drop by gravity and into an aperture 24 of an awaiting conveyor plate 24.

The conveyor plates 24 include lateral notches 26-1 which enable the plates 24 to be attached physically to a laterally separated pair of endless conveyor chains 26-2 engaged with sprocket wheels 26-3, 26-4. The sprocket wheel 26-3 includes a drive pulley 26-5 which may be operatively connected to a motor (not shown) within the cabinet 12-3 by suitable drive belts. Thus, the sprocket wheel 26-3 may be driven which, in turn, moves the conveyor chains 26-2, in the machine direction (noted by arrow $A_m$ in FIG. 1). Indexed driven movement of the sprocket wheel 26-3 may thus allow the individual ones of the trays 26 to be indexed sequentially through the stations 30, 40, 50 and 60.

The empty containers C in the support trays 26 are sequentially conveyed in the machine direction $A_m$ to the container filling station 30. As shown in FIG. 1, the container filling station 30 includes a container lift platform 31 which is operatively coupled to a pneumatic cylinder 31-1. On operation of the cylinder 31-1, therefore, the platform 31 is raised to push the empty container upwardly from the support tray 26 so that the open end of the container is positioned more closely to the fill valve assembly 32. In such a manner, minimal so-called "tailing" of the frozen dessert discharged from the fill valve assembly 32 occurs.

Figure 3:
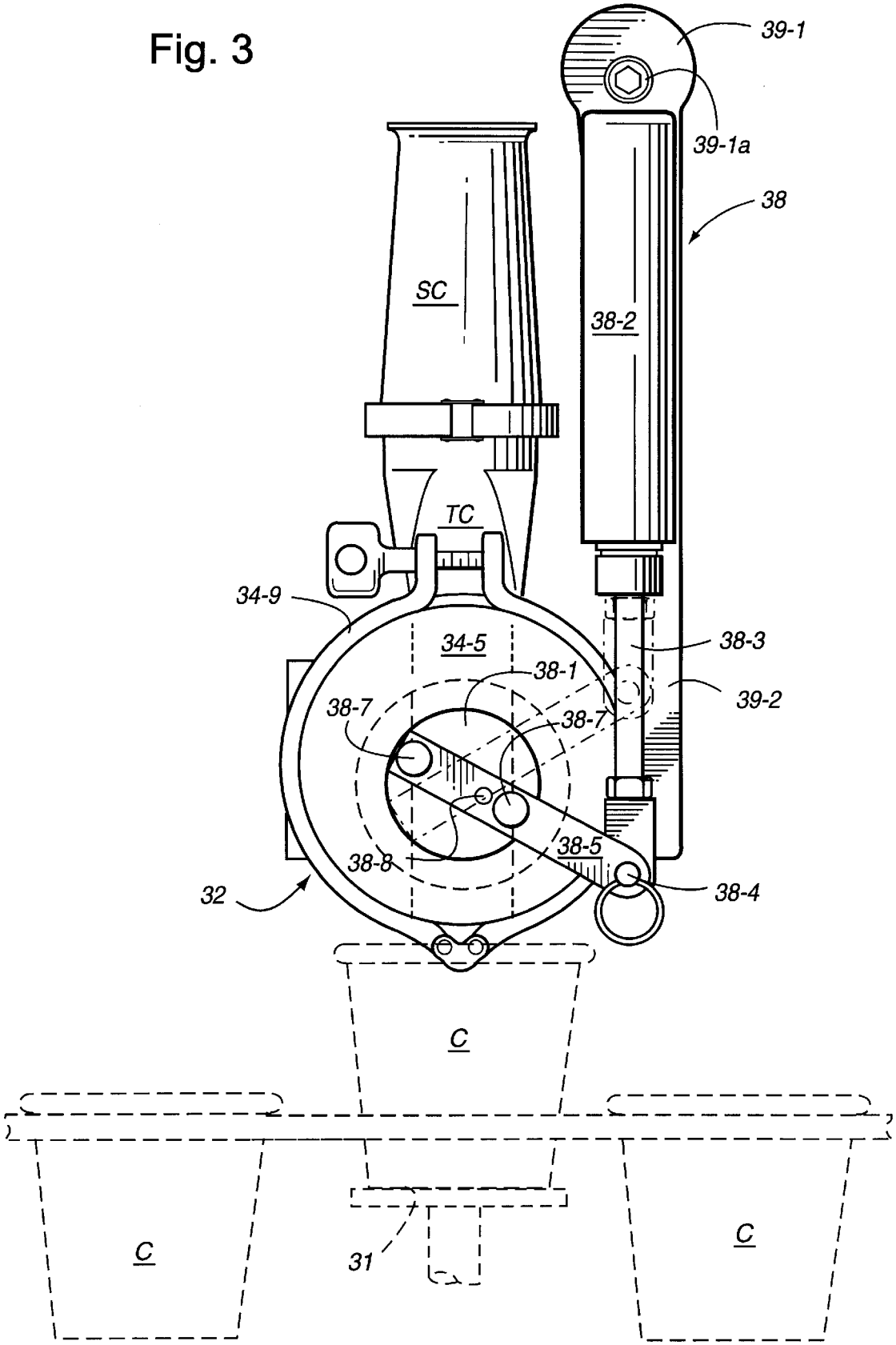
FIG. 3 is an enlarged side elevational view of the fill valve assembly according to the present invention.
Figure 4:
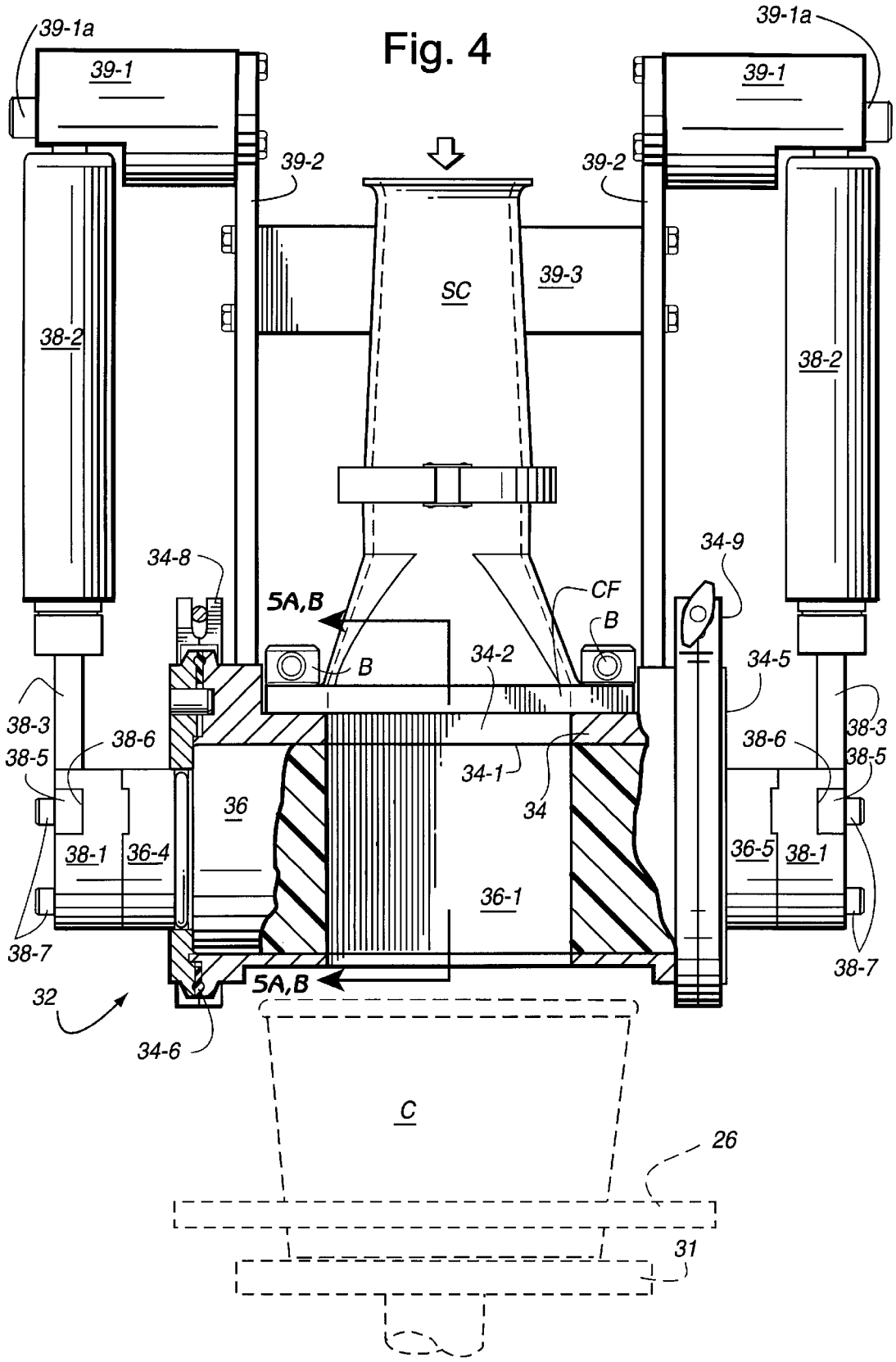
FIG. 4 is a front elevational view, partly sectioned, of the container fill valve assembly depicted in FIG. 3.
Figure 5A:
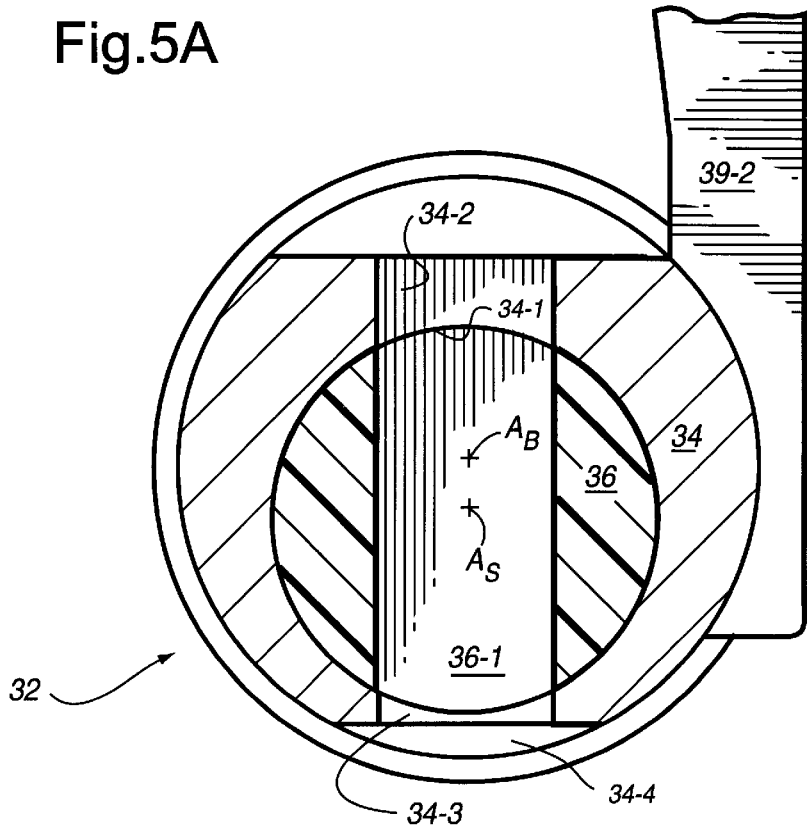
FIGS. 5A and 5B are latitudinal cross-sectional views of the preferred filling valve associated with the container filling station as taken along lines 5A,B—5A,B of FIG. 4 and depicted in an open (filling) condition and a closed (shut-off) condition, respectively.
Figure 5B:
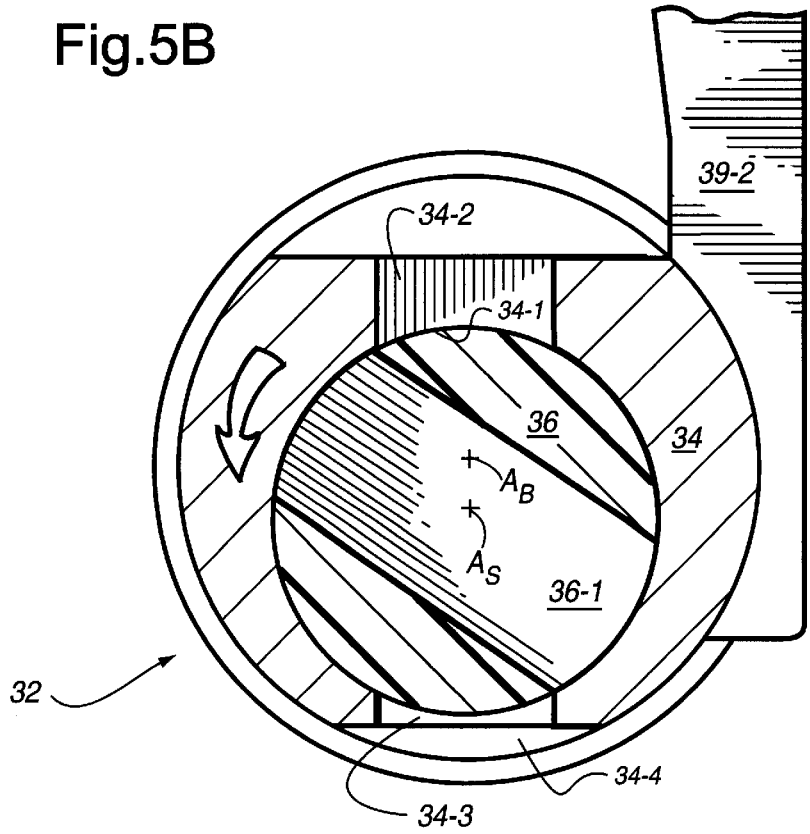

The fill valve assembly 32 is depicted more clearly in accompanying FIGS. 3 and 4. In this regard, the fill valve assembly 32 includes a generally cylindrical valve body 34 (most preferably formed of stainless steel) which defines a cylindrical interior space 34-1 and inlet and discharge openings 34-2, 34-3, respectively. A rotary valve spool 36 (most preferably formed of a rigid, wear-resistant plastics material such as, for example, nylon) is positioned within the interior space 34-1 so as to be moveable therewithin between an open condition (in which the spool port 36-1 is aligned with the inlet and discharge openings 34-2, 34-3, respectively, of the valve body 34 as shown in FIG. 5A) and a closed or shut-off condition (in which the spool port 36-1 is not aligned with the inlet and discharge openings 34-2, 34-3, respectively, of the valve body 34 as shown in FIG. 5B). Thus, while in the open condition, the fill valve allows frozen dessert to flow through the spool port 36-1 and be discharged from the discharge opening and into the awaiting container C. When in its closed condition, however, such discharge flow into the container C is terminated (i.e., since the inlet opening 34-2 is blocked by the spool body 36.

As will be noted, the cross-sectional geometry of the inlet and discharge openings 34-2, 34-3 as well as the spool port 36-1 conform closely to the geometry of the non-round containers C. Thus, as depicted, since the containers C are generally rectangular in cross-section, the geometry of the discharge openings 34-2, 34-3 and the spool port 36-1 are likewise rectangular. The frozen dessert is therefore supplied to the fill valve assembly 32 from a freezer facility by a supply conduit SC (which typically has a circular cross-sectional geometry) and then a transition conduit TC (which transitions between the circular cross section of the supply conduit and the rectangular cross-section of the inlet and discharge openings 34-2, 34-3 and the spool port 36-1. The conduits SC and TC may be joined to one another by means of a removable tension band TB. The transition conduit TC most preferably includes a conduit flange CF which may be fixed to the valve body 36 by means of removable bolts B.

The spool includes a pair of female key bosses 36-4, 36-5 which extend through the end plates 34-4, 34-5, respectively, of the valve body 34. O-ring seals (only one seal 34-6 being visible in FIG. 4) serve to seal the valve body 34 against leakage around the end plates 34-4, 34-5 for which purpose tension clamps 34-8, 34-9 are provided to positionally retain the end caps 34-4, 34-5 in sealing contact with the valve body 34.

Figure 6:
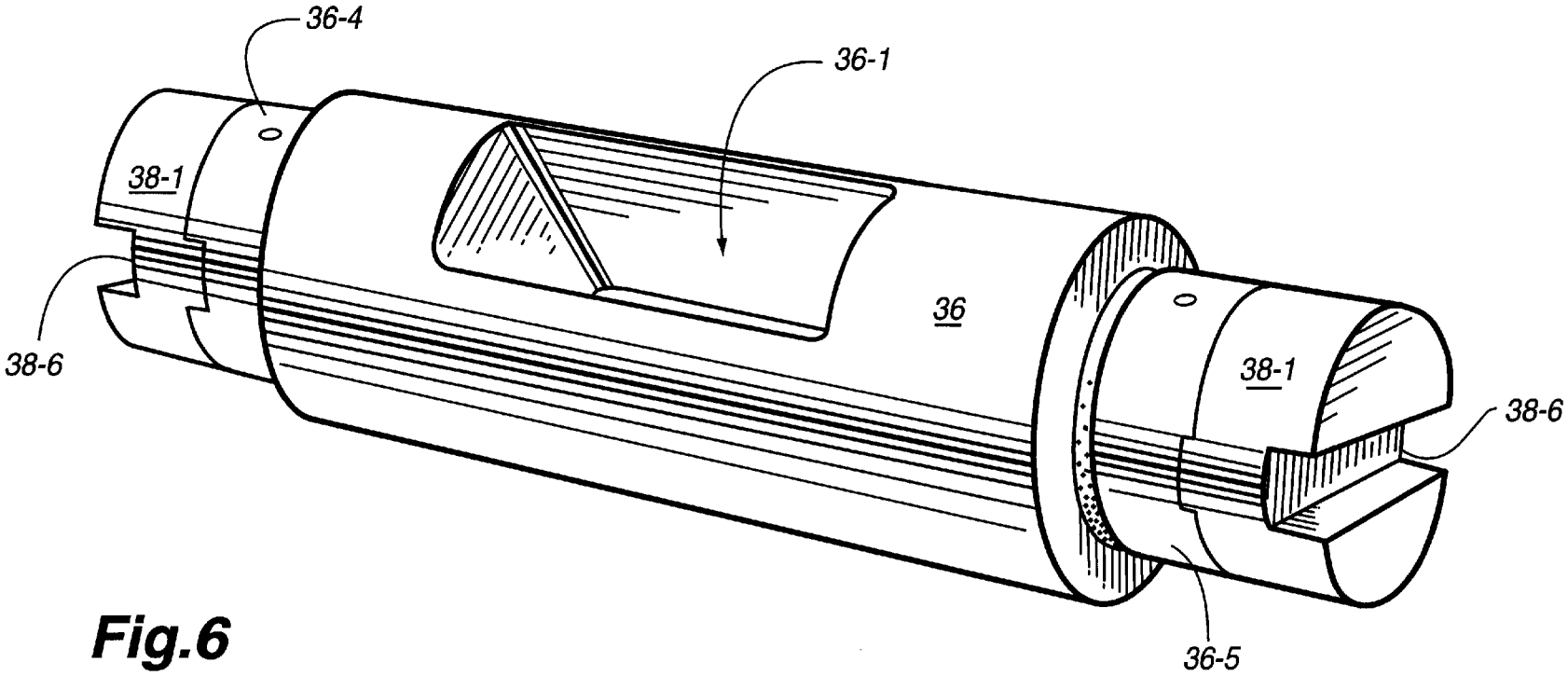
FIG. 6 is a perspective view of the valve spool employed in the container filling valve of this invention.

The female key bosses 36-4, 36-5 are engaged by respective ones of the male keys 38-1 associated with actuator assemblies 38. Specifically, the actuator assemblies 38 are provided with a pneumatic cylinder 38-2 which includes an actuator rod 38-3. The terminal end of the actuator rod 38-3 is coupled (preferably via a quick disconnect pin 38-4) to an end of the actuator lever 38-5 received within a correspondingly configured slot 38-6 of the male key 38-1 (see FIG. 6). Bolts 38-7 serve to rigidly fix the actuator lever 38-5 to the male key 38-1. Furthermore, a dowel pin 38-8 is provided as a means to ensure proper orientation of the actuator bar 38-3 within the slot 38-6 (i.e., so as to aid in the quick and efficient disassembly/assembly of the valve 32).

The actuator assemblies 38 are coupled to shoulder supports 39-1 associated with the upright support members 39-2 by means of bolts 39-1*a*. A cross-support 39-3 is most preferably provided so as to stabilize and rigidify the upright supports members 39-2.

As noted previously, the fill valve 32 of this invention significantly minimizes the "tailing" of frozen dessert between the discharge opening 34-3 and the container C when filled. In order to accomplish this minimal (if any) tailing, the valve spool 36 is eccentrically mounted for rotary movements relative to the valve body 34. That is, as shown in FIGS. 5A and 5B, the central longitudinal axis $A_s$ of the valve spool 36 is eccentrically positioned relative to the longitudinal axis $A_B$ of the valve body 34.

Furthermore, the valve body 34 at the discharge opening 34-3 is provided with a truncated recessed section 34-4 which minimizes the vertical dimension of the discharge opening 34-3 and allows the upper open end of a container C to be brought closely adjacent thereto (e.g., by means of the lift platform 31 described previously). As such, the amount of frozen dessert that "tails" between the discharge opening and the filled container C is significantly minimized as compared to conventional frozen dessert fill valves. Furthermore, since the spool 36-1 serves to reliably and cleanly sever the "tail" by virtue of its scissors-like rotary action relative to the valve body 34, the tail remnant is allowed to fall by gravity under its own weight and into the awaiting container therebelow and, as such, does not drape over the sides of the container C when indexed downstream.

After being filled with the frozen dessert at the fill station 30, the lift platform 31 is lowered and the sprockets 26-3, 26-4 indexed to the next sequential conveyor position. This subsequent indexing will thus sequentially bring the filled containers into the sanitary covering station 40 where a sanitary film covering is applied onto the open end of each filled container C. In this regard, a sanitary thermoplastics film F is supplied from a film supply roll $FS_1$ and is directed (e.g., via rollers, not shown) onto the upper edges of the containers C. A stand-by film supply roll $FS_2$ may also be provided to prevent machine down time when the roll $FS_s$ has been exhausted.

A heat-sealing head 42 is provided in station 40 upstream of a cutting head 44. Each of the heads 42, 44 is reciprocally movable into and out of contact with the upper end of the container positioned immediately therebelow. The heat-sealing head 42 will thus be operated so as to come into contact with the film-covered container C therebelow so as to heat seal a portion of the film F to the peripheral edge of the upper end of each container C. Thereafter, each container C with its heat-sealed film cover will be indexed sequentially into registry with the cutting head 44. The cutting head 44 therefore will be reciprocally operated concurrently with the heat-sealing had 42 so as to cut the heat-sealed film section about the periphery of the upper edge of the container C. The heat-sealed film section will thus remain adhered onto the upper edge of the container C while the remaining waste web (now designated WW) is taken up by the waste web roller WR.

The containers proceed on to the lidding station 50 where a paperboard lid (a few of which are noted by the identifier L) is mated with each of the sanitary film-covered containers C. In this regard, the lidding station 50 includes a lid supply assembly 52, a lid transfer assembly 54 and a lid feeding assembly 56. The lid supply assembly 52 is mounted on a pedestal support 52-1 to the frame 12. The pedestal support 52-1 thus supports a horizontally disposed feed conveyor 52-2 in vertically spaced relationship to the containers C. The feed conveyor 52-2 is most preferably driven by index motor M to deliver stacks of lids LS to the lid feeding assembly 56 via the lid transfer assembly 54. A perforated screen 52-3 is mounted along an edge of the conveyor 52-2 so as to laterally stabilize the lid stacks LS during their indexed conveyance thereon.

The lid transfer assembly 54 serves to transfer the lid stacks LS sequentially from the conveyor 52-1 (where each stack is vertically disposed) to the lid feeding assembly 56 (where the lid stack LS is angularly disposed in a downstream direction). The lid transfer assembly 54 includes a transfer arm 54-1 having at its distal end a generally U-shaped support collar 54-2 and a number of upright support posts 54-3 fixed thereto. The proximal end of the transfer arm is pivotally connected to the conveyor 52-2 so that the support collar is movable between loading position (wherein an end-most one of the lid stacks LS on the conveyor 52-2 may be indexed onto the support collar 54-2) and an unloading position (wherein the stack of lids LS picked up by the support collar 54-2 is brought into alignment with the lid stack LS supported at the feeding assembly 56).

A pair of opposed, reciprocally movable support fingers 54-4 (only one such support finger 54-4 being visible in FIGS. 7A–7E) are provided in operative association with the support collar 54-2. These support fingers 54-4 are moveable between an extended position (wherein they extended into the open interior of the support collar 54-2 so as to support the stack of lids LS thereon as the transfer arm moves between its loading and unloading positions), and a retracted position (wherein the support fingers 54-4 retract outwardly from the interior of the support collar 54-2 and thereby allow the lid stack LS to fall by gravity through the support collar 54-2 when the transfer arm is in its unloading position so as to join the lid stack LS supported by, and positioned in, the lid feeding assembly 56).

The lid feeding assembly 56, includes a pair of laterally spaced guides (only one of the guides 56-1 being visible in FIGS. 7A–7E) which are downwardly slanted in the downstream direction from the guide platform 56-2. Support posts 56-3 extend upwardly from the guide platform 56-2 and are aligned with the support posts 54-3 of the transfer assembly 54 when the transfer arm is moved into its unloading position. These support posts 56-3 serve to support the lid stack LS as the individual lids L thereof sequentially are fed by gravity to an awaiting filled container C as will be described in connection with FIGS. 7A–7E.

Figure 7A:
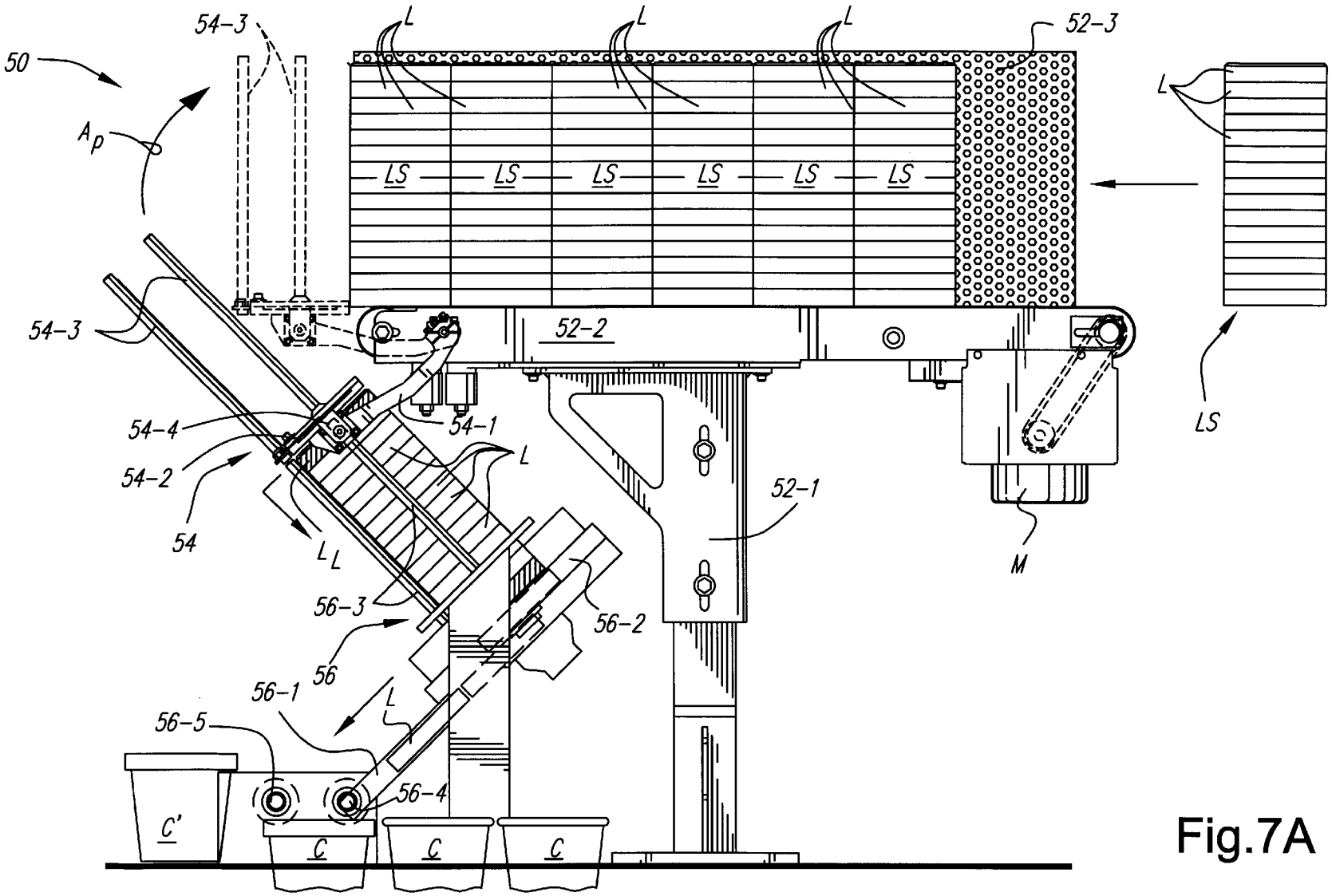
FIGS. 7A–7E are side elevational views of the container lidding station which collectively depict a sequence of its operation.
Figure 7B:
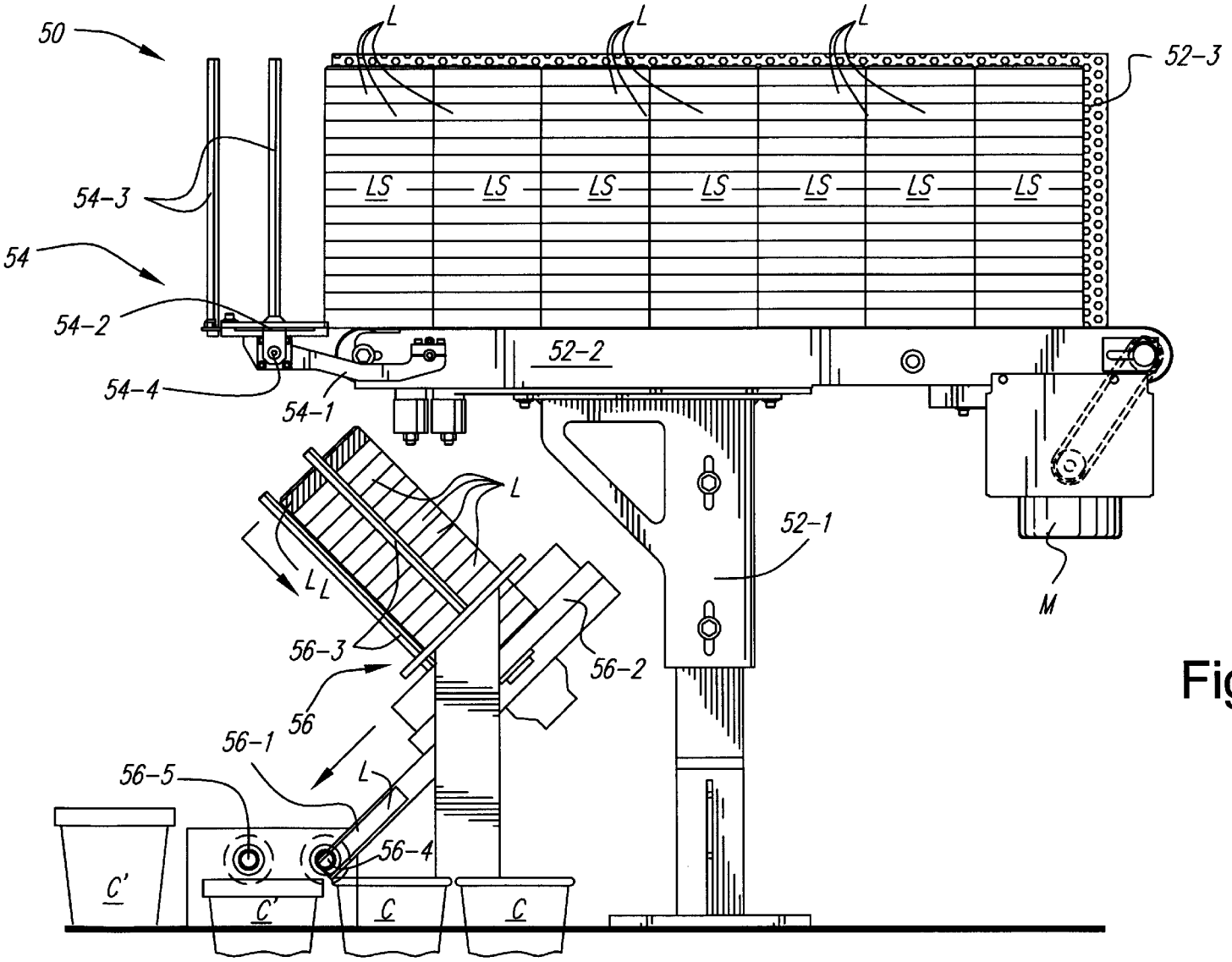

In this regard, accompanying FIG. 7A shows the state in which the last lid $L_L$ (which is also shaded in FIGS. 7A–7E for ease of recognition) in the lid stack LS supported by the lid feeding assembly 56 has just cleared (i.e., passed below) the support collar 54-2. At this stage of the cycle, the transfer assembly 54 is caused to operate which pivots the transfer arm 54-1 (arrow $A_p$) from its unloading position shown in solid line in FIG. 7A to its loading position shown in dashed line in FIG. 7A. As depicted in FIG. 7B, the lids L continue to slide by gravity downwardly along the guides 56-1 and be deposited sequentially onto an awaiting sanitary film-covered container C. Indexed advancement of the now covered containers C will cause the lids L thereon to come into contact with rollers 56-4 and 56-5 which serve to seat the lids firmly onto their respective containers C. The now finished containers (designated C') filled with frozen dessert are raised by means of a ramp (not shown) at the discharge station 60 where they may be transported to another location (e.g., via suitable conveyor) for packaging and distribution, for example.

Figure 7C:
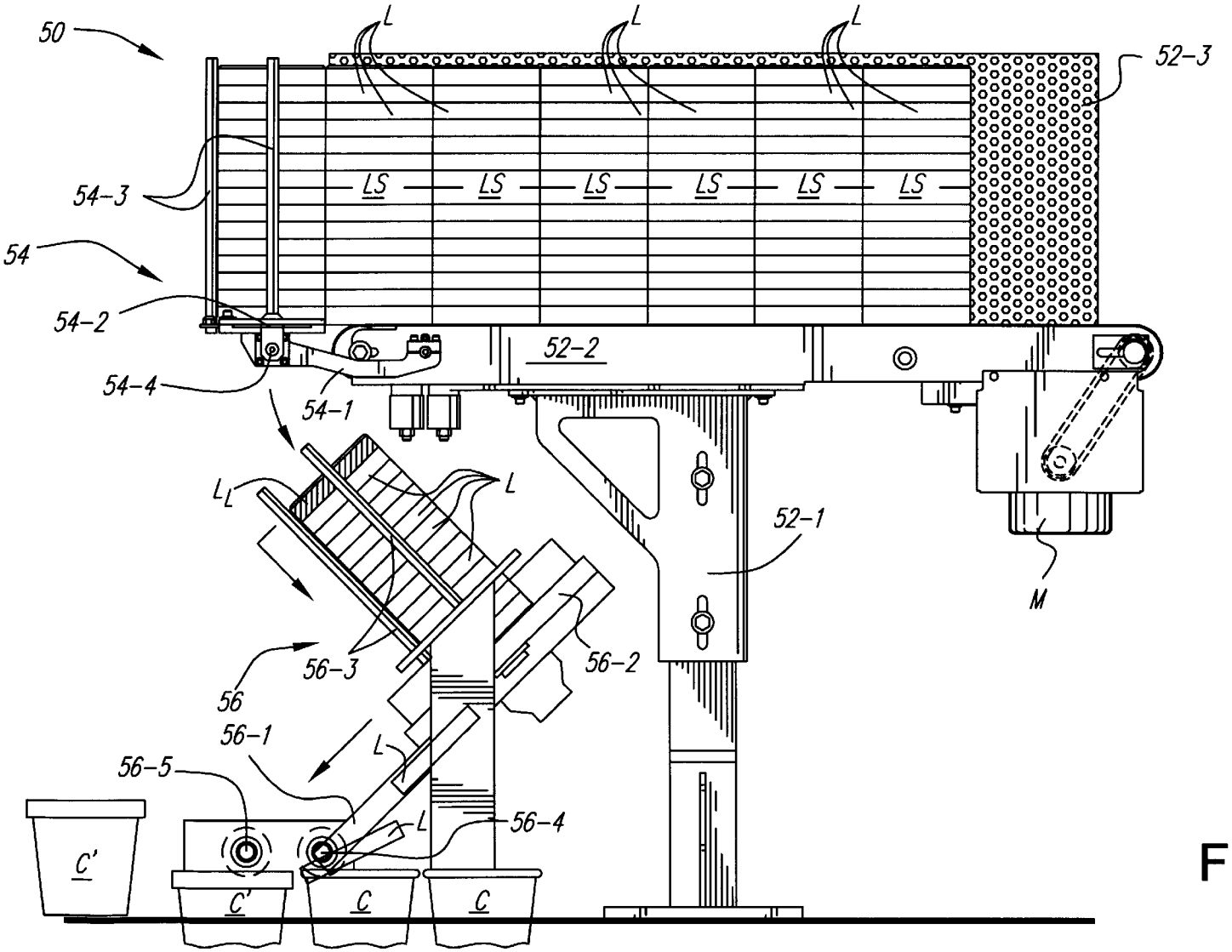

With the support collar positioned in its loading position, and with the support fingers 54-2 being extended so as to support a stack of lids LS thereon, the motor M is caused to drive the conveyor 52-2 and thereby push the last stack of lids (i.e., relative to the machine direction $A_M$) from the conveyor 52-2 and onto the support fingers 54-4 of the support collar 54-2. This state of the operation is shown in FIG. 7C.

Figure 7D:
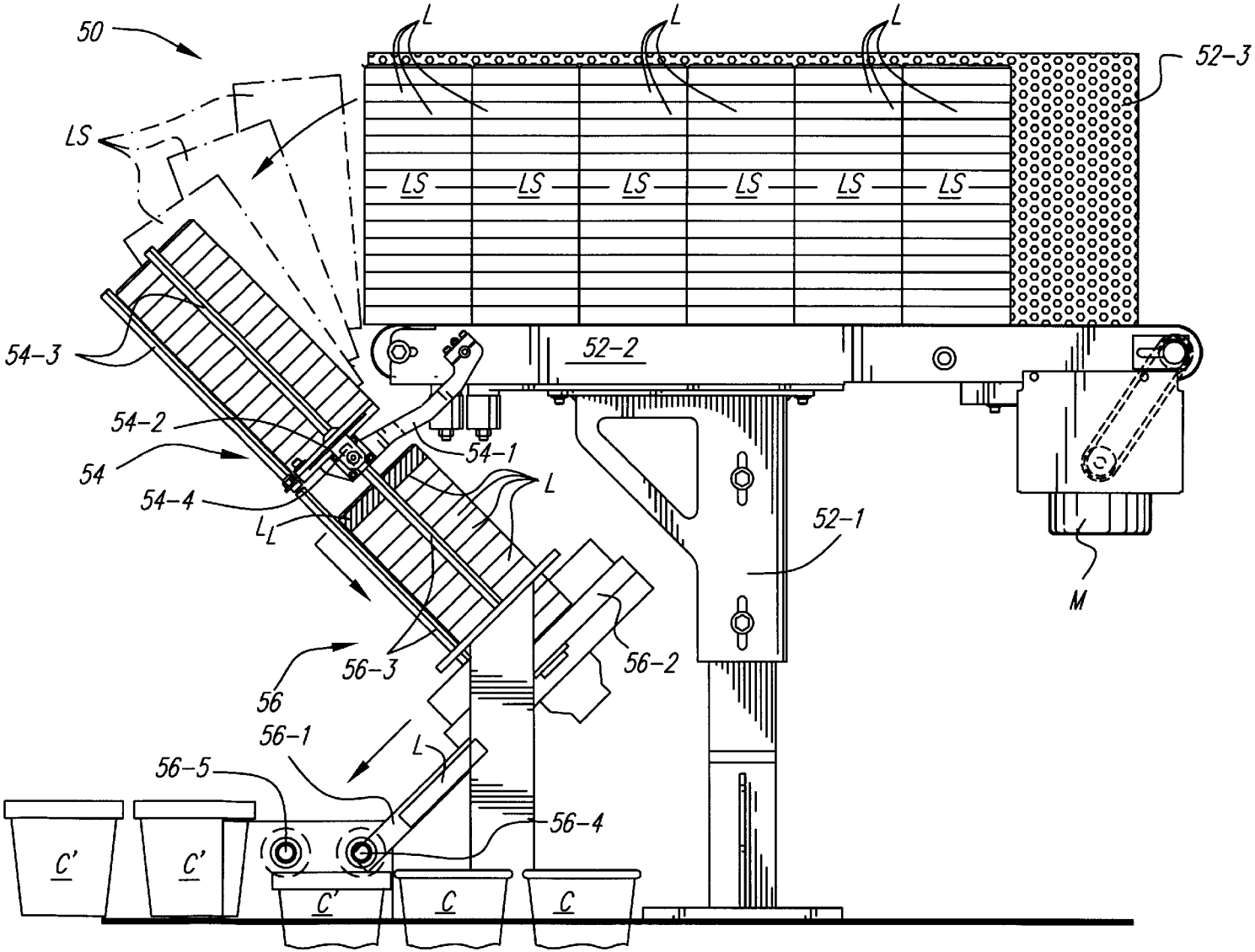
Figure 7E:
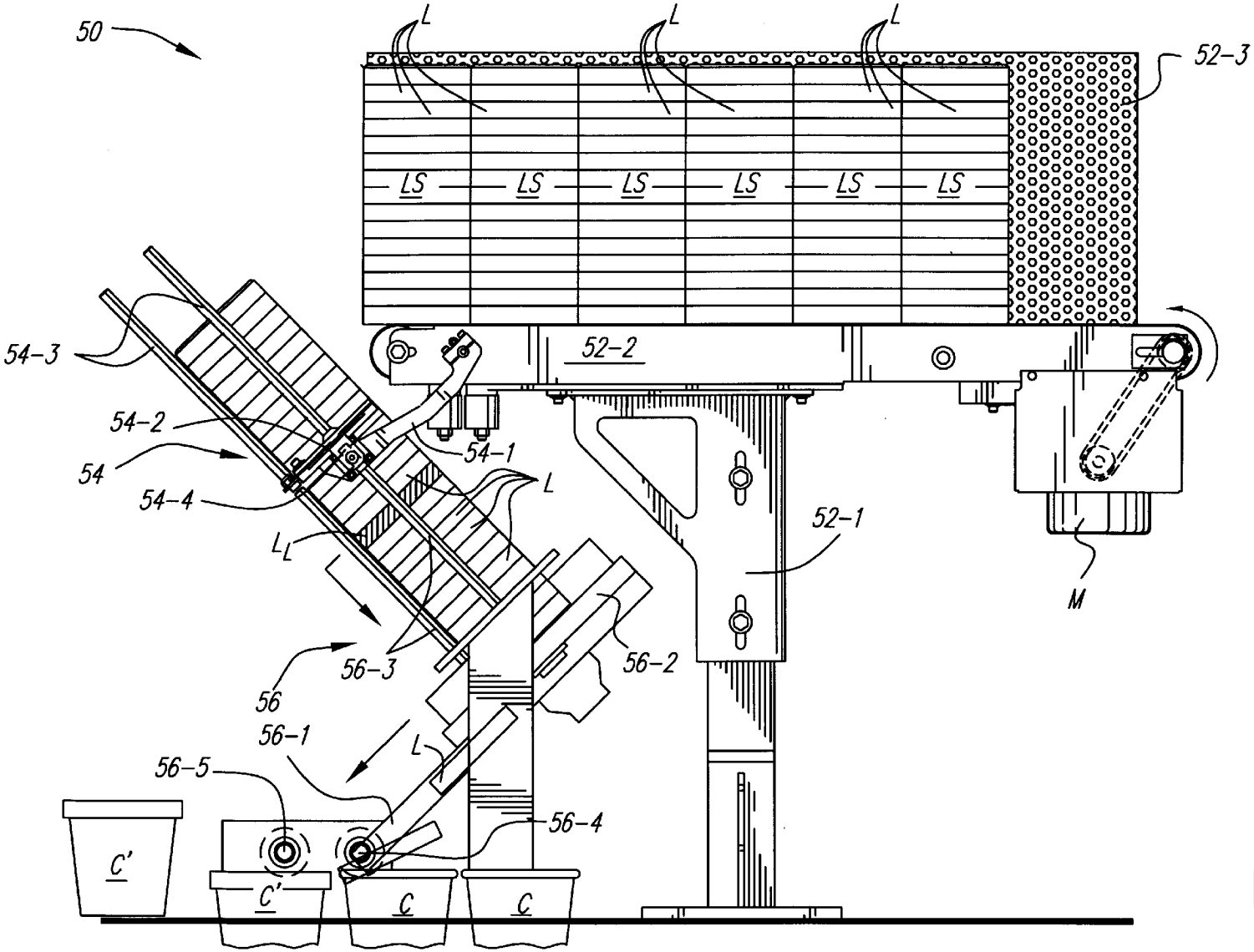

The transfer arm 54-1 is thereafter caused to pivot downwardly to move the support collar 54-2 and the stack of lids LS supported thereon by the extended fingers 54-4 into the unloading position as shown in FIG. 7D. While in its unloading position, the stacks of lids LS supported on the support collar 54-2 and on the guide platform 56-2 are aligned with one another. Thus, retraction of the fingers 54-4 will allow the stack of lids LS to pass through the support collar 54-4 until the first lid in the stack LS is in contact with the last lid $L_L$ in the stack LS supported by the guide platform 56-2. Such a state is depicted in FIG. 7E. While in such a state, the lids L will sequentially be depleted from the stack LS until the last lid in the new stack is positioned below the support collar 54-2, at which time the cycle repeats itself beginning with the sequence depicted in FIG. 7A.

Stacks of lids LS on the supply conveyor 52-2 may be replenished manually. However, it will be observed that the operation of the present invention will allow the operator some grace time between lid stack replenishments. Thus, the conveyor 52-2 provides a convenient available stand-by supply of lid stacks which are transferred automatically to the lid feeding assembly 56 as described above.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A container filling system comprising a container filling station which fills empty containers with a product, said container filling station including a fill valve assembly comprised of:

a generally cylindrical housing defining a central housing axis, and having respective inlet and discharge openings;

a cylindrical spool having a spool port defined therethrough, said spool being mounted eccentrically within said housing relative to said central housing axis for rotation about a rotation axis parallel to said central housing axis between (i) an open condition wherein the spool port is aligned with the inlet and discharge openings of the housing to allow product to be pass therethrough and discharged into an awaiting container, and (ii) a closed condition wherein the spool blocks said inlet and discharge openings to prevent product from being discharged into a container; and wherein a lower section of said generally cylindrical housing is truncated along a planar surface to establish a recess sized to allow a top portion of an empty container to be received therein.

2. The system of claim 1, wherein said housing includes a pair of opposed end plates, and wherein said spool includes a pair of opposed bosses extending though respective ones of said end plates, said fill valve assembly having an actuator assembly connected to each of said bosses and operable to rotate said spool between said open and closed conditions.

3. The system of claim 1, further comprising a film covering station downstream of said filling station to cover product-filled containers with a sanitary film cover.

4. The system of claim 3, wherein said film covering station includes a heat sealing heat to heat seal a region of a thermoplastic film to a circumferential region of a filled container's open upper end, and a cutting head which cuts the heat-sealed region from the film.

5. The system of claim 1 or 3, further comprising a lidding station for positioning a lid onto a product-filled container.

6. The system of claim 5, wherein said lidding station includes a lid supply assembly to provide an available stand-by supply of container lid stacks, a lid feeding assembly for sequentially feeding individual container lids from a lid stack supported thereby onto an awaiting product-filled container, and a lid transfer assembly for transferring a lid stack from the lid supply assembly to the lid feeding assembly.

7. The system of claim 6, wherein said lid transfer assembly includes a transfer arm which pivotally moves between a loading position, wherein a lid stack from the lid supply assembly may be loaded thereon, and an unloading position, wherein the lid stack supported by the lid transfer assembly is aligned with the lid stack supported by the lid feeding assembly.

8. The system of claim 7, wherein the lid transfer assembly includes a support collar defining an interior space through which the lid stack passes when said lid transfer assembly is in its unloading position.

9. The system of claim 8, wherein said support collar includes a pair of opposed support fingers movable reciprocally between an extended position wherein the support fingers extend into the interior space of the support collar and support a lid stack thereon, and a retracted position wherein the support fingers are retracted from the interior space of the support collar and allow the lid stack to pass therethrough.

10. The system of claim 7, wherein the lid supply assembly includes a conveyor which is moveable in indexed increments when the lid transfer assembly is in said loading position.

11. A container lid supply and transfer system which sequentially supplies individual lids to respective awaiting containers being advanced incrementally in a conveyance direction, and which comprises:

a lid supply assembly to provide an available stand-by supply of container lid stacks, a lid feeding assembly which supports a container lid stack for sequentially feeding individual container lids from a bottom of the container lid stack and onto an awaiting product-filled container, and a lid transfer assembly for transferring a lid stack from the lid supply assembly to the lid feeding assembly; wherein said lid feeding assembly having a guide member which is downwardly slanted downstream relative to said conveyance direction to guide the individual lids from the bottom of the lid stack and onto the awaiting product-filled container;

said lid feeding assembly includes elongate support posts extending upwardly from said guide member and in a downstream director relative to said conveyance direction, said support posts supporting said lid stack to allow for individual ones of the container lids in the said lid transfer assembly includes a transfer arm which pivotally moves between a loading position, wherein a lid stack from the lid supply assembly may be loaded thereon, and unloading position, wherein the lid stack supported by the lid transfer assembly is aligned with the lid stack supported by the lid feeding assembly upstream direction relative to said conveyance direction.

12. The system of claim 11, wherein the lid transfer assembly includes a support collar defining an interior space through which the lid stack passes when said lid transfer assembly is in its unloading position.

13. The system of claim 12, wherein said support collar includes a pair of opposed support fingers movable reciprocally between an extended position wherein the support fingers extend into the interior space of the support collar and support a lid stack thereon, and a retracted position wherein the support fingers are retracted from the interior space of the support collar and allow the lid stack to pass therethrough.

14. The system of claim 12 or 13, wherein the lid supply assembly includes a conveyor which is moveable in indexed increments when the lid transfer assembly is in said loading position.

15. A fill valve assembly for filling non-round containers with a frozen dessert comprising:

a generally cylindrical housing defining a central housing axis, and having respective non-round inlet and discharge openings;

a cylindrical spool having a non-round spool port defined therethrough, said spool being mounted eccentrically within said housing relative to said central housing axis for rotation about a rotation axis parallel to said central housing axis between (i) an open condition wherein the spool port is aligned with the inlet and discharge openings of the housing to allow product to be pass therethrough and discharged into an awaiting container, and (i) a closed condition wherein the spool blocks said inlet and discharge openings to prevent product from being discharged into a container; and wherein a lower section of said generally cylindrical housing is truncated along a planar surface to establish a recess sized to allow a top portion of an empty container to be received therein.

16. The fill valve assembly of claim 15, wherein said housing includes a pair of opposed end plates, and wherein said spool includes a pair of opposed bosses extending through respective ones of said end plates, said fill valve assembly having an actuator assembly connected to each of said bosses and operable to rotate said spool between said open and closed conditions.

17. The fill valve assembly of claim 16, wherein the housing is formed of stainless steel, and wherein said spool is formed of a rigid plastics material.

* * * * *